US005317857A

United States Patent [19]

Allison

[11] Patent Number: 5,317,857

[45] Date of Patent: Jun. 7, 1994

[54] STANDARDIZED PORTABLE HOUSING UNIT

[76] Inventor: Robert S. Allison, 203 B Lentz Rd., Yulee, Fla. 32097

[21] Appl. No.: 922,066

[22] Filed: Jul. 29, 1992

Related U.S. Application Data

[63] Continuation-in-part of Ser. No. 799,561, Nov. 27, 1991, Pat. No. 5,193,325.

[51] Int. Cl.[5] ..... E04H 5/06

[52] U.S. Cl. ..... 52/791; 52/125.6; 52/79.1; 52/79.9; 52/DIG. 9

[58] Field of Search ..... 52/125.2, 125.6, 143, 52/79.1, 79.9, DIG. 9, 791 OR, 799; 248/407, 423

[56] References Cited

U.S. PATENT DOCUMENTS

| | | | |
|---|---|---|---|
| 2,751,635 | 6/1956 | Donnahue | 52/79.9 |
| 4,485,608 | 12/1984 | Kaufman et al. | 52/79.9 |
| 4,530,196 | 7/1985 | O'Bryan | 52/DIG. 9 |
| 4,833,841 | 5/1989 | Ellington, III | 52/143 |
| 4,854,094 | 8/1989 | Clark | 52/DIG. 9 |
| 5,193,325 | 3/1993 | Allison | 52/79.9 |

FOREIGN PATENT DOCUMENTS

| | | | |
|---|---|---|---|
| 1953109 | 8/1978 | Fed. Rep. of Germany | 52/79.1 |
| 2940573 | 4/1981 | Fed. Rep. of Germany | 248/423 |
| 2461075 | 3/1981 | France | 248/423 |
| 2576624 | 8/1986 | France | 52/79.1 |
| 0674233 | 5/1990 | Switzerland | 52/79.1 |
| 9003477 | 9/1989 | World Int. Prop. O. | 52/79.1 |

*Primary Examiner*—Carl D. Friedman
*Assistant Examiner*—Wynn E. Wood
*Attorney, Agent, or Firm*—Arthur G. Yeager

[57] ABSTRACT

A housing unit with wooden framing having a vertical rigid load supporting beam attached to the housing unit at each vertical corner thereof, and having legs telescopically extendable at each end of the beam with a fitting at the outer end of each leg, each fitting having a plurality of eyes to facilitate attachment to a lifting cable. The upper legs and fittings attached thereto may be removed and reattached spacedly downwardly along the unit, front and back, to provide additional foundation support. All the legs extending downwardly may be vertically adjusted so that the unit may be horizontally level on, for example, uneven ground.

17 Claims, 1 Drawing Sheet

STANDARDIZED PORTABLE HOUSING UNIT

RELATED APPLICATIONS

This is a continuation-in-part of copending patent application Ser. No. 07/799,561 filed Nov. 27, 1991, now U.S. Pat. No. 5,193,325 by Robert S. Allison.

BACKGROUND OF THE INVENTION

Mobile home units are well known in this country and elsewhere in the world. For the most part these units are on a permanently attached frame with wheels and axles and are transported along the highways by being pulled behind a prime mover of some sort, e.g., a truck tractor. In more recent times one or more mobile home units are transported from the manufacturer to a home site where the home units are placed on a suitable foundation. These are not truly mobile homes because they do not have wheels and axles for movement to another location. They are lifted by crane, fork lift trucks, jacks or the like from the ground at the manufacturing location, to a highway truck and from the highway truck to the ground at the eventual home site. Such manufactured housing is capable of being transported by ship but is not capable of being efficiently loaded in stacks as are cargo containers. In my copending patent application Ser. No. 07/799,561 filed Nov. 27, 1991 there is disclosed a housing unit supported in a frame having a horizontal base and two vertical end structures, the entire structure being transportable having any of several embodiments of supporting structures on the ends of the housing unit supporting standard fittings with lifting eyes. One embodiment is a vertical corner beam attached to each vertical corner of the housing unit. It has now been found that if these beams are telescopically extendable, it is highly advantageous.

It is an object of this invention to provide an improved portable housing unit which is capable of shipment as standardized marine cargo. It is another object of this invention to provide a standardized house as a cargo unit that is readily transferred from a ship to a truck for delivery and set-up at a home site. Still other objects will become apparent in the more detailed description which follows.

BRIEF SUMMARY OF THE INVENTION

This invention relates to a transportable enclosed housing unit having a frame with a horizontal base and floor element, two horizontally long front and back vertical walls and two short vertical end walls joined to form four vertical corners and a sloping roof; a rigid vertical telescopic beam structure attached to said housing unit at each corner; said beam having at each end thereof a fitting with a plurality of lifting eyes; all of the fittings adapted to form three pairs of parallel planes which enclose a right prismatic space with every part of the housing unit lying inside the planes.

In different embodiments of the invention the corner beam structures have a telescopic leg at each end thereof and with the fitting having lifting eyes on the outer end of each leg.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The novel features of this invention are best understood by reference to the attached drawings.

Figure 1:
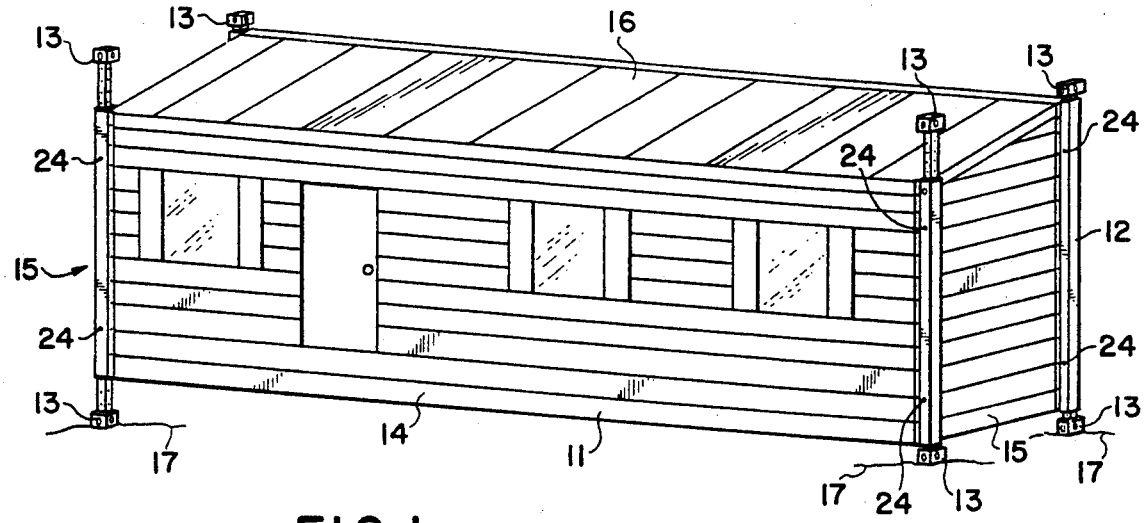
FIG. 1 is a perspective view of the housing unit of this invention with corner beam structures of this invention.

In FIG. 1 there is shown a housing unit 11 having a wooden, plastic, composite or cementitious frame work, with a wooden horizontal base and floor element, and any selected type of siding whether it be wooden, metal, plastic, masonry, or the like. The housing unit 11 may be a portable home unit (i.e., a mobile home without the wheeled chassis) or other structure for residence, for storage, for office space, or the like, with all interior walls, appliances, etc. installed. This invention does not relate to the housing unit design or its structure except as it is modified by corner beam assemblies 12 to make it stackable and transportable. The requirements that make the housing unit transportabbe are those of overall dimensions which are specified for cargo units that are transportable by truck, ship, or airplane. In general, the housing unit is transportable by truck, by ship, and even by airplane. The size regulations for ship freight are set forth by the International Standards Organization as ISO 668-1979(E) for freight containers 20 feet, 30 feet, or 40 feet long. The largest size is most suitable for a housing unit and is approximately 40 feet long, 8 feet wide and 9 feet high. These dimensions are ones which are preferred for the overall dimensions of the housing structure of this invention.

Figure 5:
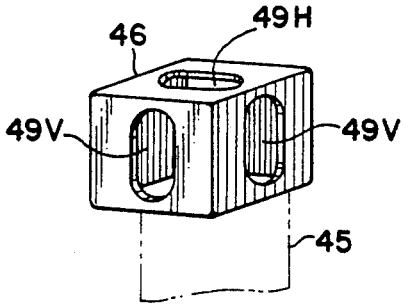
FIG 5 PRIOR ART
FIG. 5 is a perspective view of a lifting eye fitting of the prior art.

Housing unit 11 has two parallel front and back vertical walls 14 and two vertical end walls 15 perpendicular to walls 14 forming four vertical corners. A corner beam assembly 12 is rigidly attached to each vertical corner of housing unit 11. The four corner beam assemblies are strong enough to support the entire housing unit 11 and other similar units 11 which may be stacked above. The entire structure of housing unit 11 and four corner beam assemblies 12 occupy the same prismatic space as a marine cargo container of the standard ISO dimensions. At each of the eight corners of that prismatic space is an arrangement of lifting eyes 20, preferably ISO corner fittings, as shown in FIG. 5, having three outwardly facing oval eyes on three contiguous planes of the fitting. These eyes may be machined, torch burned, or otherwise built into the corner beam assemblies 12. FIG. 1 shows four corner beam assemblies rigidly attached to housing unit 11 by bolting.

Figure 4:
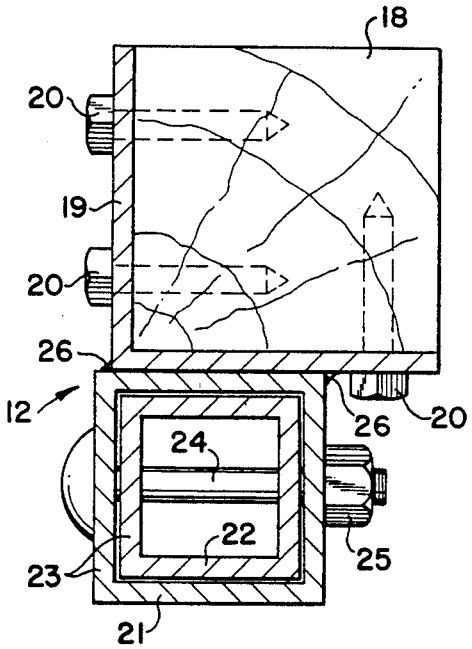
FIG. 4 is a cross sectional view taken at 4—4 of FIG. 2.

Each corner beam assembly 12 preferably includes two components rigidly, e.g., by welding, attached to each other. One component is an angle beam 19, preferably steel on other rigid load bearing material, which is firmly attached to the corner stud 18 where one wall 14 and one wall 15 meet to form a corner. Angle beam 19 preferably is bolted or screwed to corner stud, e.g., by lag bolts 20 as shown in FIG. 4.

Figure 2:
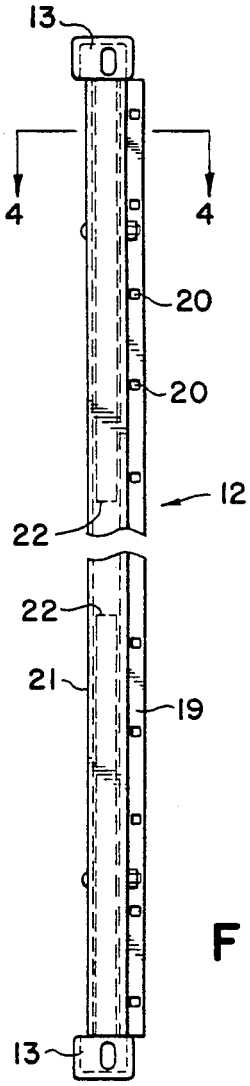
FIG. 2 is a top plan view of the corner beam structure of this invention.
Figure 3:
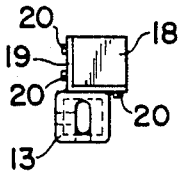
FIG. 3 is a front elevational view of the corner beam structure of this invention.

The second component of corner beam assembly 12 is a load supporting beam with telescopically extendable end portions. In FIGS. 2 and 3 the preferred embodiment is shown to include an outside square tubular beam 21 and inside square extension legs 22 which are selectively extendable over some short length out each end of outside beam 21. Extension legs 22 can be fixed at any length by the use of bolts 24 and nuts 25 passing through bolt holes 23 in both outside beam 21 and inside extension leg 22. The outer end of each extension leg 22 is welded to a fitting 13 with lifting eyes preferably an ISO fitting corresponding to ISO Specification 1161 of International Standard ISO 668-1979(E). Extension legs 22 may be of any convenient length, although practicality considerations would set the maximum length to be about one-half the length of outside square beam 21 which, in turn, is about the same length as L-shaped angle beam 19 or about the same length as stud 18. In a normal housing unit beam 19 and corner stud 18 will be from 7½ to 8 feet long, and this will require that extension legs be from about 2 feet long to about 3¾ feet to 4 feet long.

Extension legs 22 at the top end of square beam 21 are useful to set the level of the four top fittings 13 at the same elevation. Extension legs 22 at the bottom end of square beam 22 are particularly useful in allowing the housing unit 11 to be placed on uneven ground as shown at 17 of FIG. 1 and yet have level floors and ceilings inside the housing unit 11. Furthermore, short hollow beams, similar to beams 21, may be attached at spaced locations along the front and back of the housing unit 11 adjacent the base and floor element for receiving respective upper extension legs 22 to provide additional foundation support. It is understood that such short hollow beams would each have an opening for attachment of the extension leg by bolt 24 and nut 25 removed from the upper housing unit. A flat mounting plate with openings may be welded to the face of each short hollow beam and extend outwardly therefrom for fastening the plate to the base and floor element by lag bolts, like bolts 20.

The four corner beam structures 12 have attached at each end thereof lifting eyes 13 to fit the lifting means available on the transportation system. Preferably these lifting eye fittings 13 are made to meet ISO specifications (ISO-1161) as illustrated in FIG. 5 which are metal castings with oval eyes that cooperate with oval twist pins that provide quick, secure locking and unlocking by twisting a pin when engaged with the eye. These ISO fittings 13 with oval eyes are used in ship freight lifting operations, in securing the cargo to a truck container chassis trailer, in employing jacks for lifting, and in securing one housing unit 11 to another contiguous housing unit 11. It is not necessary to employ ISO castings (as in FIG. 5) since such eyes may be burned into or cut out of a plate or beam. Also, there may be other means employed to clamp one housing unit 11 to another housing unit 11, but at the present time only ISO fittings are commonly used by ocean-going vessels.

The materials of construction for housing unit 11 and for corner beam assemblies 12 are not critical. Nevertheless the housing unit 11 is preferably one with a wooden, plastic, composite or cementitious framework with a wooden base and floor element over which are attached siding materials and/or roofing materials. These outside materials may be metal, plastic, composites of plastics and fiber-reinforcing materials, laminates of two or more materials, and the like. housing unit 11 is preferably one with a wooden framework over which are attached siding materials and/or roofing materials. These outside materials may be metal, plastic, composites of plastics and fiber-reinforcing materials, laminates of two or more materials, and the like.

Corner beam assemblies 12 are made of rigid load-supporting materials, preferably metal, such as steel, iron, aluminum, brass, etc. Other strong materials may be used, such as plastics, laminates, composites, etc. The combination of an outer beam 21 and an inner leg 22 to provide telescopic connections can be done with any cross sectional shapes, e.g., circular, square, trapezoidal, triangular, etc. It is preferable to employ an angular cross-sectional shape, such as square, so that there will be a nonrotational relationship between outer beam 21 and inner legs 22. Because of availability and low cost, steel is the preferred material for beam assembly 12. Similarly, beam 19 which serves as a seat for wooden corner studs 18, preferably is steel, although other rigid load-bearing materials are useful, such as plastics, laminates, composites, etc. These corner beams 19 may be attached to wooden corner studs 18 by any secure means, preferably by bolts, screws, or nails, with or without the assistance of a cement. In FIG. 4, lag bolts 20 are used for this purpose.

As seen, convertible hardware has been disclosed which may be attached to a factory built housing unit which allows such unit to be stacked and shipped by the standard equipment used to ship overseas containers. At delivery such hardware converts into a permanent and adjustable house foundation which facilitates supporting the unit level horizontally and on unlevel and irregular ground.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A transportable enclosed housing unit having a frame with a horizontal wooden base and floor element, two horizontally long front and back vertical walls and two short vertical end walls joined to form four vertical corners, and a sloping roof; a rigid vertical telescopic beam structure attached to said housing unit at each said corner; said beam structure having at each end thereof a fitting with a plurality of lifting eyes, all of said fittings adapted to form three pairs of parallel planes which enclose a right prismatic space with every part of said housing unit lying inside all of said planes.

2. The housing unit of claim 1 wherein said beam includes a rigid angle seat adapted to receive a corner stud of said housing unit.

3. The housing unit of claim 2 wherein said beam is a steel beam.

4. The housing unit of claim 3 wherein said beam is an elongated L-shaped steel beam bolted to a corner stud of said housing unit and welded to an elongated parallel tubular beam having a telescopic extension leg at each end thereof, and one of said fittings at the outer end of each said leg.

5. The housing unit of claim 1 wherein said fitting with a plurality of lifting eyes is a hollow, rectangular, prismatic metallic casting with five mutually perpendicular faces at least of said faces having an oval passage therethrough.

6. A transportable enclosed housing unit having a frame with a horizontal rectangular wooden base and floor element, a pair of spaced horizontally elongated vertical walls and a pair of spaced shortened vertical walls joined to form four vertical corners, said walls being rigidly affixed along respective edge portions of said rectangular base and floor element, and a sloping roof spaced from and overlying said element and being connected to upper edges of said vertical walls; a rigid vertical telescopic beam structure attached to said housing unit at each said corner; said beam structure having at each end thereof a fitting with a plurality of spaced lifting eyes, all of said fittings adapted to form three pairs of parallel planes which enclose a right prismatic space with every part of said housing unit lying inside all of said planes.

7. The housing unit of claim 6 wherein each said beam structure includes a rigid angle seat adapted to receive and be mounted to a respective corner stud of said housing unit.

8. The housing unit of claim 7, wherein each said beam structure is a steel beam.

9. The housing unit of claim 8 wherein each said beam structure is an elongated L-shaped steel beam bolted to a corner stud of said housing unit, each said beam structure including an elongated tubular beam welded to said L-shaped beam and having a telescopic extension leg at each end thereof, said fittings being respectively mounted to an outer end of respective said leg.

10. The housing unit of claim 6 wherein said fitting is a member having at least three adjoining outwardly exposed faces with said eyes respectively in respective said faces.

11. The housing unit of claim 6 wherein each said beam structure includes an elongated tubular hollow beam, elongated telescopic extension leg being slidingly disposed in each end portion of said hollow beam, said fittings being mounted to an outer end of respective said leg, and means for selectively locking said extension leg to said hollow beam whereby said housing unit may be supported on uneven ground by said fittings engaged to cause said floor element to be positioned horizontally.

12. The housing unit of claim 11 wherein said means for selectively locking includes equally vertically spaced openings in each of said tubular members and each of said extension legs and a plurality of headed bolts passing respectively through aligned said openings in each said tubular member and its said extension leg, and a nut threadedly attached to respective said bolt outwardly of respective tubular member.

13. The housing unit of claim 6 wherein each said beam structure has a lower end portion and a lower extension leg adjacent thereto, said fitting at said end below said housing unit being attached to said lower extension leg for supporting said housing unit on ground.

14. The housing unit of claim 13 wherein each of said beam structures has an upper end portion and an upper extension leg adjacent thereto, said fitting at said end above said housing unit being attached to said upper extension leg, said upper extension leg being detachably secured to said beam structure for providing additional ground support when attached spacedly along and secured to said base and floor element.

15. The housing unit of claim 6 wherein each of said beam structures includes an elongated hollow tubular beam and a telescopic lower extension leg extending below said housing unit and carrying respective said fitting whereby said housing unit may be supported on said fittings of said lower legs on uneven ground by adjustment of said leg into and outwardly of said tubular beam.

16. The housing unit of claim 15 further comprising means for selectively locking said lower legs to respective said tubular beams at various extensions below said housing unit.

17. The housing unit of claim 16 wherein each said beam structure includes a telescopic upper extension leg extending above said housing unit and carrying respective said fitting, said upper extension legs being detachably secured for providing additional ground support when reattached spacedly along said base and floor element.

* * * * *